US008726463B2

(12) United States Patent
Bushey et al.

(10) Patent No.: US 8,726,463 B2
(45) Date of Patent: May 20, 2014

(54) WRAP AROUND FURNITURE GLIDE

(76) Inventors: Richard D. Bushey, Kenosha, WI (US); Bret L. Bushey, Caledonia, WI (US)

( * ) Notice: Subject to any disclaimer, the term of this patent is extended or adjusted under 35 U.S.C. 154(b) by 168 days.

(21) Appl. No.: 13/293,395

(22) Filed: Nov. 10, 2011

(65) Prior Publication Data

US 2012/0110786 A1 May 10, 2012

Related U.S. Application Data

(60) Provisional application No. 61/412,182, filed on Nov. 10, 2010.

(51) Int. Cl.
*A47B 91/06* (2006.01)

(52) U.S. Cl.
USPC ..... 16/42 T; 16/42 R

(58) Field of Classification Search
USPC ..... 16/42 R, 42 T, 32, 33; 248/346.11, 188.9
See application file for complete search history.

(56) References Cited

U.S. PATENT DOCUMENTS

| | | | |
|---|---|---|---|
| 1,112,828 | A | 10/1914 | Neuberth |
| 1,230,836 | A | 6/1917 | Ballenberg |
| 1,382,833 | A | 6/1921 | Hurd |
| 1,383,806 | A | 7/1921 | Haynes |
| 1,486,267 | A | 3/1924 | Salomon |
| 1,603,876 | A | 10/1926 | Shapard |
| 1,690,754 | A | 11/1928 | Rosenthal |
| 1,818,211 | A | 8/1931 | Duncan, Jr. |
| 1,804,841 | A | 1/1932 | Pedroli |
| 1,861,095 | A | 5/1932 | Schacht |
| 1,867,736 | A | 7/1932 | Finkeldey |
| 1,903,609 | A | 4/1933 | Uhl |
| 1,915,272 | A | 6/1933 | Duncan, Jr. |
| 1,982,138 | A | 11/1934 | Herold |
| 2,030,649 | A | 2/1936 | Miller |
| 2,116,941 | A | 5/1938 | Francis |
| 2,234,577 | A | 3/1941 | Reiter |
| 2,262,063 | A | 11/1941 | Swarr |
| 2,262,064 | A | 11/1941 | Swarr |
| 2,633,599 | A | 4/1953 | Dolan |
| 2,644,978 | A | 7/1953 | Becker |
| 2,710,027 | A | 6/1955 | Husgen et al. |
| 2,753,586 | A | 7/1956 | Metz |
| 2,794,205 | A | 6/1957 | Skupas |
| 2,820,240 | A | 1/1958 | Matys |
| 2,840,113 | A | 6/1958 | Simpson et al. |
| 2,848,733 | A | 8/1958 | Thornsbury |
| 2,865,133 | A | 12/1958 | Hoven et al. |
| 2,875,552 | A | 3/1959 | Stillman |
| 2,878,509 | A | 3/1959 | Fisher |
| 2,888,775 | A | 6/1959 | Thoeming |
| 2,902,794 | A | 9/1959 | Ehrgott |
| 2,904,294 | A | 9/1959 | Marygold |
| 2,933,754 | A | 4/1960 | Winans |
| 2,954,636 | A | 10/1960 | Gammache |

(Continued)

*Primary Examiner* — William Miller
(74) *Attorney, Agent, or Firm* — Boyle Fredrickson, S.C.

(57) ABSTRACT

A furniture glide configured to wrap around a base portion of a chair frame is disclosed. The furniture glide is of multi-layer construction. A first layer is flexible and configured to engage the chair frame. A second layer, bonded to the first layer, is cushioned. A third layer is configured too engage the floor and is made of a durable material to handle the wear associated with engaging the floor. Side portions of the first layer wrap around the base portion of the chair to easily attach the furniture glide to the chair.

16 Claims, 2 Drawing Sheets

(56) References Cited

U.S. PATENT DOCUMENTS

| | | | | | |
|---|---|---|---|---|---|
| 2,968,116 | A | | 1/1961 | Arenson | |
| 2,974,352 | A | | 3/1961 | Lockwood | |
| 2,988,770 | A | | 6/1961 | Arenson | |
| 2,992,509 | A | | 7/1961 | Gaenzle | |
| 2,996,753 | A | * | 8/1961 | Kramcsak, Jr. | 16/42 R |
| 3,059,267 | A | | 10/1962 | Wilhelmi | |
| 3,078,498 | A | | 2/1963 | Morgan | |
| 3,177,518 | A | | 4/1965 | Bergstrom | |
| 3,183,545 | A | | 5/1965 | Bergstrom | |
| 3,191,212 | A | | 6/1965 | Reiss, Sr. et al. | |
| 3,254,362 | A | | 6/1966 | Rasor et al. | |
| 3,342,445 | A | | 9/1967 | Bouwkamp | |
| 3,353,231 | A | | 11/1967 | Levine | |
| 3,389,421 | A | | 6/1968 | Wheeler | |
| 3,505,724 | A | | 4/1970 | Leitner et al. | |
| 3,620,896 | A | | 11/1971 | Glasgow | |
| 3,634,925 | A | | 1/1972 | Van Loo | |
| 3,640,496 | A | | 2/1972 | Duncan | |
| 3,845,924 | A | | 11/1974 | Taviere et al. | |
| 3,883,923 | A | | 5/1975 | England | |
| 4,327,460 | A | | 5/1982 | Wolff | |
| 4,468,910 | A | | 9/1984 | Morrison | |
| D276,606 | S | | 12/1984 | Neuwirth | |
| 4,576,357 | A | | 3/1986 | Schrepfer | |
| 4,654,245 | A | | 3/1987 | Balzer et al. | |
| 5,010,621 | A | * | 4/1991 | Bock | 16/39 |
| 5,042,764 | A | | 8/1991 | Carpinella et al. | |
| 5,057,356 | A | | 10/1991 | Smith | |
| 5,081,740 | A | | 1/1992 | Smith | |
| 5,094,416 | A | | 3/1992 | Huon | |
| 5,160,105 | A | | 11/1992 | Miller | |
| 5,170,972 | A | | 12/1992 | Guell | |
| 5,220,705 | A | | 6/1993 | Bushey | |
| D339,560 | S | | 9/1993 | Byrd | |
| D348,985 | S | | 7/1994 | Walker | |
| 5,330,814 | A | | 7/1994 | Fewell | |
| D353,505 | S | | 12/1994 | Rea | |
| 5,426,818 | A | * | 6/1995 | Bushey | 16/42 R |
| 5,469,599 | A | | 11/1995 | Wurdack | |
| 5,513,900 | A | | 5/1996 | Iglesias | |
| 5,557,824 | A | | 9/1996 | Bushey | |
| 5,573,212 | A | | 11/1996 | Palazzolo | |
| 5,573,213 | A | | 11/1996 | Henderson et al. | |
| D376,944 | S | | 12/1996 | Dunn | |
| 5,591,974 | A | | 1/1997 | Troyer et al. | |
| 5,603,140 | A | | 2/1997 | Pryce | |
| D381,865 | S | | 8/1997 | Gallagher | |
| 5,680,673 | A | | 10/1997 | Beshore | |
| 5,782,444 | A | | 7/1998 | Anderman et al. | |
| 5,802,669 | A | | 9/1998 | Wurdack | |
| D400,088 | S | | 10/1998 | Hurrie | |
| 5,898,975 | A | | 5/1999 | Hancock | |
| 5,946,737 | A | | 9/1999 | Fleege | |
| D415,672 | S | | 10/1999 | Students et al. | |
| 6,088,877 | A | | 7/2000 | Swy et al. | |
| 6,154,923 | A | | 12/2000 | Carpinella | |
| 6,280,817 | B1 | | 8/2001 | McCrossin et al. | |
| 6,324,725 | B1 | | 12/2001 | Green | |
| 6,353,951 | B1 | | 3/2002 | Gramling | |
| D455,383 | S | | 4/2002 | Sneed | |
| 6,647,589 | B1 | | 11/2003 | Youngwith | |
| 6,855,651 | B2 | | 2/2005 | Yu | |
| 7,237,302 | B2 | * | 7/2007 | Bushey | 16/32 |
| 8,234,751 | B2 | * | 8/2012 | Bushey et al. | 16/42 R |
| 8,438,701 | B2 | * | 5/2013 | Bushey | 16/42 T |
| 2005/0183234 | A1 | * | 8/2005 | Bushey et al. | 16/42 R |
| 2008/0040889 | A1 | * | 2/2008 | Edwards | 16/42 R |
| 2010/0018005 | A1 | * | 1/2010 | Bushey | 16/42 T |

* cited by examiner

FIG. 1
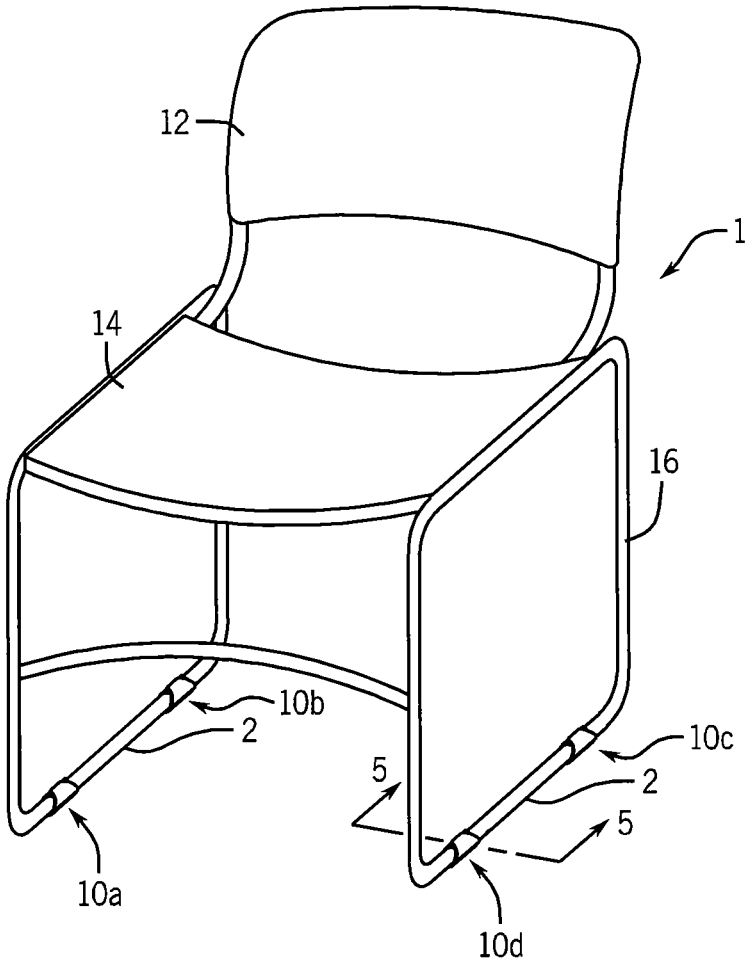
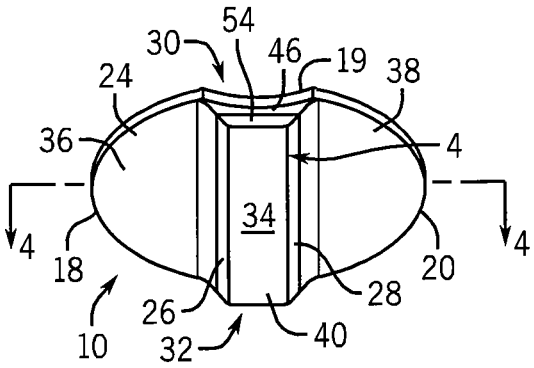
FIG. 2
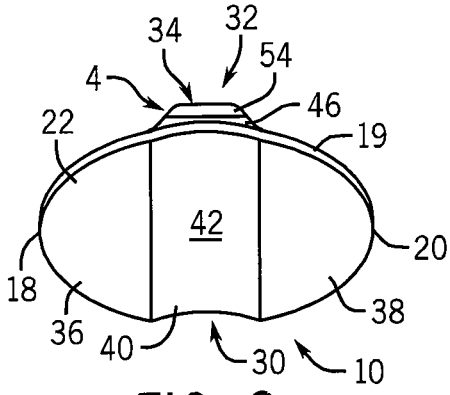
FIG. 3

WRAP AROUND FURNITURE GLIDE

CROSS-REFERENCE TO RELATED APPLICATIONS

This application claims priority from U.S. Provisional Patent Application Ser. No. 61/412,182 filed on Nov. 10, 2010, the entirety of which is expressly incorporated by reference herein.

FIELD OF THE INVENTION

This invention relates generally to furniture glides, and in particular, to a furniture glide that wraps around a base portion of a tubular chair frame or a foot mounted to the terminal end of a leg of a piece of furniture.

BACKGROUND AND SUMMARY OF THE INVENTION

Coasters are often used under the legs of a piece of furniture to act as a buffer between the legs and the floor on which the piece of furniture rests. Typically, coasters take the form of glass or rubber discs having flat bottoms that rest on the floor. By positioning the coasters between the furniture legs and the floor, the weight of the furniture leg is dispersed over a larger area such that the furniture leg does not scratch or mar the floor when the piece of furniture is moved or leave a depression in the floor when the piece of furniture remains in one place for an extended period of time.

In addition, furniture glides or sliders have been developed that are also positioned between the legs of a piece of furniture and the carpeting on which the piece of furniture rests. By way of example, Bushey, U.S. Pat. No. 5,220,705 discloses a furniture glide that facilitates the movement of a piece of furniture on carpeted and bare floors. The furniture glide includes a convo-convex disc having an arcuate convex lower surface, a concave upper surface defining a central cavity, and resilient pad fixed to the disc upper surface within the central cavity below the edge thereof. Adhesive is provided for securing the resilient pad to the bottom of the piece of furniture or to the leg of the piece of furniture.

While functional for their intended purpose, these prior art furniture glides have certain limitations. More specifically, these prior furniture glides are designed for mounting onto the bottoms of pieces of furniture or on the legs thereof. As a result, the furniture glides do not fit properly on pieces of furniture that are fabricated using tubular frames, such as office chairs and the like. Further, repeated movement of a piece of furniture along a floor may cause the furniture glide to become detached from the bottom of the piece of furniture. As a result, the furniture glide may become separated from the piece of furniture such that the bottom of the piece of furniture may engage and damage the flooring.

In order to cover these deficiencies, furniture glides have been developed which are intended to be securely retained on a tubular frame of a piece of furniture. By way of example, Bushey, U.S. Pat. No. 7,237,302 discloses a furniture glide having an inner surface for engaging a bottom of a tubular leg of a piece of furniture and an outer surface for engaging a supporting surface. First and second sidewalls project from opposite sides of the base and have inner surfaces for engaging opposite sides of the leg of the piece of furniture. Each sidewall is pivotable between a first storage position wherein the sidewall is spaced from a corresponding side of the leg and a second operating position wherein the sidewall is in engagement with the corresponding side of the leg. It is noted that the furniture glide disclosed in the '302 patent incorporates slits in the sidewalls thereof to facilitate the wrapping of the sidewalls of the furniture glide about the outer periphery of a tubular leg of a piece of furniture. These slits, in turn, increase the production cost of the furniture glide. In addition, given the slits in the sidewalls and the thin felt material from which the furniture glide is fabricated, the durability of the furniture glide disclosed in the '302 patent can be somewhat limited.

Therefore, it is a primary object and feature of the present invention to provide a furniture glide that may be securely retained on a tubular frame of a piece of furniture.

It is a further object and feature of the present invention to provide a furniture glide that is inexpensive to manufacture and simple to utilize.

It is a still further object and feature of the present invention to provide a furniture glide that is more securely retained on the leg of a piece of furniture than prior furniture glides.

It is a still further object and feature of the present invention to provide a furniture glide that is more durable than prior furniture glides.

According to one embodiment of the invention, a furniture glide for mounting to a leg of a piece of furniture includes a flexible furniture engaging layer, a cushion layer, and a floor engaging layer. The furniture engaging layer includes a first surface engageable with the furniture and a second surface. The cushion layer includes a first surface, operatively connected to the second surface of the furniture engaging layer, and a second surface. The cushion layer extends over at least a portion of the second surface of the furniture engaging layer. The floor engaging layer has a first surface, operatively connected to the second surface of the cushion layer, and a second surface for engagement with a supporting surface.

According to another aspect of the invention, each of the cushion layer and the furniture engaging layer have melting points. The melting point of the cushion layer is less than the melting point of the furniture engaging layer. A first portion of the cushion layer is melted to the furniture engaging layer.

According to still another aspect of the invention, the furniture engaging layer includes a first side portion, extending along a longitudinal axis; a second side portion, extending generally opposite from the first side portion along the longitudinal axis; and an intermediate portion, defined between the first side portion and the second side portion. In addition, the first and second side portions may wrap around the leg of the piece of furniture. The first portion of the first surface is generally concave to engage the leg of the piece of furniture. An adhesive layer may also be applied to the first surface of the furniture engaging layer.

According to another embodiment of the invention, a furniture glide for mounting to a leg of a piece of furniture includes a floor engaging layer, a cushion layer, and a furniture engaging layer. The floor engaging layer has a first side, a second side, an inner surface, an outer surface, and a thickness. The cushion layer has a first surface and a second surface bonded to the inner surface of the floor engaging layer. The furniture engaging layer has a first surface; a second surface bonded to the first surface of the cushion layer; a first side portion, extending beyond the first side of the floor engaging layer; a second side portion, extending beyond the second side of the floor engaging layer; and a thickness. The thickness of the furniture engaging layer is less than the thickness of the floor engaging layer.

According to yet another embodiment of the invention, a furniture glide for mounting to a leg of a piece of furniture includes a furniture engaging layer, a cushion layer, and a floor engaging layer. The furniture engaging layer has a first side portion, a second side portion opposite the first side portion, an intermediate portion defined between the first and second side portions, an inner surface engageable with a bottom of the leg of the piece of furniture, and an outer surface. The cushion layer is bonded to the furniture engaging layer and has an inner and outer surface. The floor engaging layer has an inner surface, an outer surface, a first side, and a second side. The outer surface of the floor engaging layer extends between the first and the second sides, is generally planar, and is configured to engage a supporting surface. The first and second side portions of the floor engaging layer are movable between a first storage configuration and a second operating configuration. In the storage configuration, the inner surfaces of the first and second side portions are generally co-planer with the inner surface of the intermediate portion. In the operating configuration, the first and second side portions are in engagement with the leg.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is an isometric view of a chair incorporating a furniture glide in accordance with the present invention mounted thereto;

FIG. 2 is an isometric view showing the furniture glide of FIG. 1 from the lower surface and a side surface;

FIG. 3 is an isometric view showing the furniture glide of FIG. 1 from the upper surface and a side surface;

DETAILED DESCRIPTION OF THE PREFERRED EMBODIMENT

Figure 4:
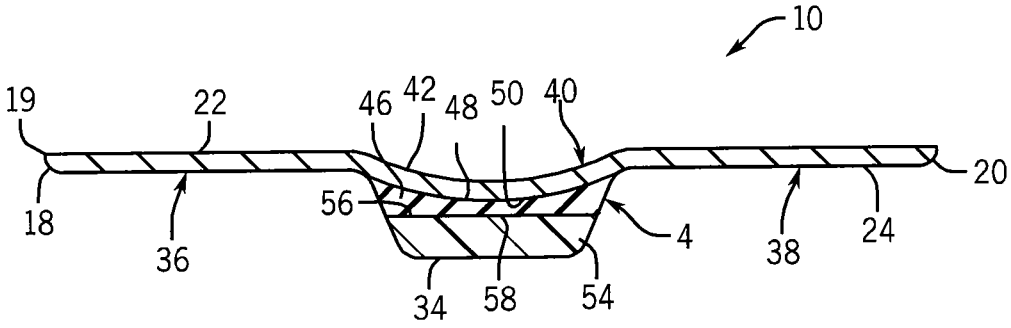
FIG. 4 is a cross sectional view of the furniture glide of the present invention taken along line 4-4 of FIG. 2.
Figure 5:
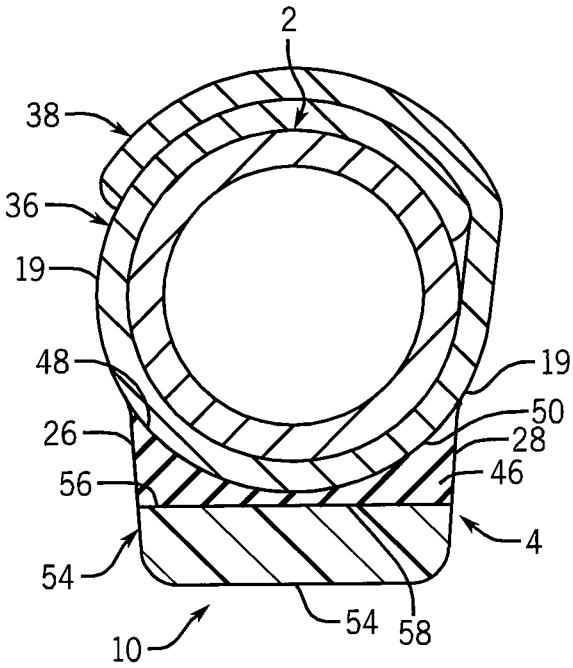
FIG. 5 is a cross sectional view of the furniture glide of the present invention taken along line 5-5 of FIG. 1.

Referring to FIG. 1, a wrap around furniture glide in accordance with the present invention is generally designated by the reference numeral 10. It is intended that the furniture glide 10 be receivable on a base portion 2 of a conventional chair 1. According to an exemplary application, the chair 1 includes a backing member 12 and a seating member 14 interconnected by a tubular frame 16. The tubular frame 16 includes two, generally parallel, horizontal base portions 2 which are intended to support the chair 1 on a supporting surface such as a floor or the like.

As best seen in FIGS. 2-4, the furniture glide 10 is generally oblong in shape and includes a first layer 19 having a first end 18, a second end 20 opposite from the first end 18, an inner surface 22, and an outer surfaces 24 opposite from the inner surface 22. It is contemplated that the furniture glide 10 may be round or may have other configurations without deviating from the scope of the present invention. According to one embodiment of the invention, the first layer 19 is fabricated from a flexible material, such as a polyester fabric or thin felt. It is contemplated for the inner surface 22 of the first layer 19 to include an adhesive thereon for affixing the furniture glide 10 to the base portion 2 of the chair 1. The furniture glide 10 further includes a generally rectangular floor engaging element 4 extending from the outer surface 24 of the first layer 19. The floor engaging element has a first side 26, a second side 28, a first end 30, and a second end 32 that partially define an outer periphery 9 of the floor guide 10. The floor engaging element 4 terminates at a generally flat floor engaging surface 34.

The first layer 19 of the furniture glide 10 is defined by a first side portion 36, extending between a first side 26 of the floor engaging element 4 and a first end 18 of the furniture glide 10; a second side portion 38, extending between a second side 28 of the floor engaging element 4 and a second end 20 of the furniture glide 10; and an intermediate portion 40, extending between the first and second side portions 36 and 38, respectively. An upper surface 42 of the intermediate portion 40 of the first layer 19 is generally concave and adapted for forming a mating relationship with the outer surface of a corresponding horizontal base portion 2 of the chair 1.

The floor engaging element 4 is defined by a cushion layer 46 and a floor engaging layer 54. The cushion layer 46 has a generally concave upper surface 48 bonded to the convex lower surface 50 of the intermediate portion 40 of the first layer 19. The floor engaging layer 54 has an upper surface 56 bonded to the lower surface 58 of the cushion layer 46 and a lower surface defining the floor engaging surface 34 of the floor engaging element 4. It is contemplated for the cushion layer 46 to be fabricated from a vinyl material. It is further contemplated for the floor engaging layer 54 to be fabricated from a heavy duty felt, for reasons hereinafter described.

In order to interconnect the lower surface 58 of the cushion layer 46 to the upper surface 56 of the floor engaging layer 54, the vinyl forming cushion layer 46 is heated to a desired level. Thereafter, the upper surface 56 of the floor engaging layer 54 positioned on and urged into the lower surface 58 of the cushion layer 46 such that the upper surface 56 of the floor engaging layer 54 is infused into the lower surface 58 of the cushion layer 46. Once cooled, the cushion layer 46 is cured so as to capture the upper surface 56 of the floor engaging layer 54 therein. In order to interconnect the concave upper surface 48 of the cushion layer 46 to the convex lower surface 50 of the intermediate portion 40 of the first layer 19, it contemplated to melt cushion layer 46 at a temperature less than the melting point of the first layer 19. As cushion layer 46 melts, cushion layer 46 and first layer 19 are compressed such that portions of the melted vinyl of the cushion layer 46 flow into the first layer 19 between the fibers thereof. As the vinyl material cools, cushion layer 46 solidifies such that the portions of the cushion layer 46 are captured within the fibers of the first layer 19, thereby bonding the cushion layer 46 to the first layer 19 without damage to such fibers. In other words, each of the fibers of the first layer 19 are fused into and captured within solidified cushion layer 46.

As described, the floor engaging element 4 has a thickness greater than the thickness of the first and second side portions 36 and 38, respectively, of the furniture glide 10. The thickness of the floor engaging element 4 of the furniture glide 10 adds durability to the furniture glide 10, thereby allowing the chair 1 to be repeatedly slid over a supporting surface without damage to the furniture glide 10.

In operation, the furniture glide 10 is positioned underneath the base portion 2 of the chair frame 16 such that the floor engaging surface 34 of the floor engaging element 4 is directed away from the chair frame 16 and such that the upper surface 42 of the intermediate portion 40 of the first layer 19 receives the outer surface of a corresponding horizontal base portion 2 of the chair 1 in a mating relationship. The first and second side portions 36 and 38, respectively, of the furniture glide 10 are wrapped around the base portion 2 of the chair frame 16 such that a portion of one of the first and second side portions 36 and 38, respectively, overlaps the other. The adhesive on the inner surface 22 of the first layer 19 of the furniture glide 10 maintains the spatial relationship of the furniture glide 10 with respect to the base portion 2 of the chair frame 16. It can be appreciated that the process may be repeated so as to mount additional furniture glides 10*a*-10*c* on the base portions 2 of the chair frame 16. It is intended for the cushion layer 46 of furniture glide 10 to distribute the load on furniture glide 10 and to cushion the chair 1 during engagement with a supporting surface.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A furniture glide for mounting to a leg of a piece of furniture, comprising:

a flexible furniture engaging layer having a first surface engageable with the furniture and a second surface, the furniture engaging layer including first and second edges and a concave trough formed in the first surface which extends from the first edge to the second edge;

a cushion layer having a first surface bonded to the second surface of the furniture engaging layer such that at least a portion of the first surface of the cushion layer is captured within the furniture engaging layer and having a second surface, the cushion layer extending over at least a portion of the second surface of the furniture engaging layer; and a floor engaging layer having a first surface infused into the second surface of the cushion layer and having a second surface for engagement with a supporting surface.

2. The furniture glide of claim 1 wherein the cushion layer and the furniture engaging layer have melting points, the melting point of the cushion layer being less than the melting point of the furniture engaging layer.

3. The furniture glide of claim 2 wherein the portion of the cushion layer is melted into the furniture engaging layer such that the portion of the first surface of the cushion layer is captured within the furniture engaging layer.

4. The furniture glide of claim 1 wherein the furniture engaging layer includes a first side portion extending along a longitudinal axis, a second side portion extending generally opposite from the first side portion along the longitudinal axis, and an intermediate portion defined between the first side portion and the second side portion.

5. The furniture glide of claim 4 wherein the first and second side portions of the furniture engaging layer are configured to wrap around the leg of the piece of furniture.

6. The furniture glide of claim 1 further comprising an adhesive layer applied to the first surface of the furniture engaging layer.

7. A furniture glide for mounting to a leg of a piece or furniture, comprising:

a floor engaging layer including a first side, a second side, an inner surface, an outer surface, and a thickness;

a cushion layer having a first surface and a second surface infused into to the inner surface of the floor engaging layer; and a furniture engaging layer having a first surface, a second surface bonded to the first surface of the cushion layer such that at least a portion of the first surface of the cushion layer is captured within the furniture engaging layer, a first side portion extending beyond the first side of the floor engaging layer, a second side portion extending beyond the second side of the floor engaging layer, and a thickness, wherein:

the furniture engaging layer including first and second edges and a concave trough formed in the first surface thereof which extends from the first edge to the second edge; and the thickness of the furniture engaging layer is less than the thickness of the floor engaging layer.

8. The furniture glide of claim 7 wherein the cushion layer and the furniture engaging layer have melting points, the melting point of the cushion layer being less than the melting point of the furniture engaging layer.

9. The furniture glide of claim 8 wherein the portion of the first surface of the cushion layer is melted into the furniture engaging layer such that the portion of the first surface of the cushion layer is captured within to the furniture engaging layer.

10. The furniture glide of claim 8 wherein the outer surface of the floor engaging layer is generally planar and configured to engage a support surface.

11. The furniture glide of claim 7 wherein the furniture engaging layer is made of a flexible material and each of the first and second side portions are configured to wrap around the leg of the piece of furniture.

12. The furniture glide of claim 11 further comprising an adhesive layer applied to the first surface of the furniture engaging layer.

13. A furniture glide for mounting to a leg of a piece of furniture comprising:

a furniture engaging layer having a first side portion, a second side portion opposite the first side portion, an intermediate portion defined between the first and second side portions, first and second opposite edges, an inner surface engageable with a bottom of the leg of the piece of furniture, and an outer surface, the inner surface of the furniture engaging layer including a concave trough extending from the first edge to the second edge of the furniture engaging layer;

a cushion layer bonded to the furniture engaging layer such that at least a portion of the cushion layer is captured within the furniture engaging layer, the cushion layer having an inner surface and an outer surface; and a floor engaging layer infused into the cushion layer and having an inner surface, an outer surface, a first side, and a second side;

wherein:

the outer surface of the floor engaging layer extends between the first and the second sides, is generally planar, and is configured to engage a supporting surface; and the first and second side portions of the furniture engaging layer are movable between a first storage configuration wherein the inner surfaces of the first and second side portions are generally co-planer with the inner surface of the intermediate portion and a second operating configuration wherein the first and second side portions are in engagement with the leg.

14. The furniture glide of claim 13 wherein at least portions of the first and second side portions of the floor engaging layer overlap in the operating configuration.

15. The furniture glide of claim 13 wherein the cushion layer and the furniture engaging layer have melting points, the melting point of the cushion layer being less than the melting point of the furniture engagement layer.

16. The furniture glide of claim 15 wherein the portion of cushion layer is melted into the furniture engaging layer such that the portion of the cushion layer is captured within the furniture engaging layer.

* * * * *